United States Patent [19]

Diermayer et al.

[11] 4,284,235

[45] Aug. 18, 1981

[54] VENT CONTROL ARRANGEMENT FOR COMBUSTION APPARATUS

[76] Inventors: Werner Diermayer, 1275 Panorama Dr., Lafayette, Calif. 94549; Luitpold Kutzner, Marschnerstrasse 78, D-8000 Munich, Fed. Rep. of Germany

[21] Appl. No.: 105,101

[22] Filed: Dec. 19, 1979

[51] Int. Cl.[3] ..... F23N 3/00

[52] U.S. Cl. ..... 236/1 G; 236/68 R; 251/11

[58] Field of Search ..... 236/1 G, 68 R; 251/11; 431/20; 126/285 B

[56] References Cited

U.S. PATENT DOCUMENTS

| | | | |
|---|---|---|---|
| 3,645,443 | 2/1972 | Willson et al. | 236/34 |
| 4,039,123 | 8/1977 | Frankel | 236/1 G |
| 4,079,884 | 3/1978 | Sherman | 236/1 G |
| 4,175,695 | 11/1979 | Cresswell | 236/1 G |
| 4,193,541 | 3/1980 | Scheidweiler | 236/1 G |
| 4,205,783 | 6/1980 | Dietsche et al. | 236/1 G |

*Primary Examiner*—William E. Tapolcai, Jr.
*Attorney, Agent, or Firm*—Flehr, Hohbach, Test, Albritton & Herbert

[57] ABSTRACT

Combustion apparatus having a vent with a damper actuated by an element comprised of a material having a shape memory effect. The element is heated and cooled above and below the deformation temperature for causing the element to deform between its different shapes for changing the position of the damper within the vent. Control means is provided in one embodiment for heating the shape memory element so that it deforms for moving the damper closed during a shutdown mode of the combustion apparatus, and in another embodiment the shape memory element is heated so that it deforms to a shape for holding the damper open during the heating mode of the apparatus.

10 Claims, 4 Drawing Figures

VENT CONTROL ARRANGEMENT FOR COMBUSTION APPARATUS

Gas- and oil-fired heating appliances, such as furnaces, water heaters and boilers, are equipped with a vent for the removal of products of combustion. During standby and off periods warm air flows from the appliance and its surroundings to the outside, causing heat loss.

Automatic vent dampers are installed in the vents of such appliances to conserve heat energy by closing the vent when the appliance is in the off or standby mode.

Some of these vent damper designs are electrically operated. The dampers are usually actuated in one direction by a solenoid or by an electric motor with reduction gears, and in the other direction by a spring.

One object of the invention is the supply of motive power for both directions, namely opening and closing of the damper, by one element.

Another object is to simplify the design and manufacture of electrically operated vent dampers, and to reduce the number of components, moving parts, and especially friction surfaces required for opening, closing, closing delay and safety functions as well as assuming and maintaining the open position on power failure or upon removal of the damper actuating unit.

A further object of the invention is to improve the function and reliability of electrically operated vent dampers.

Figure 2:
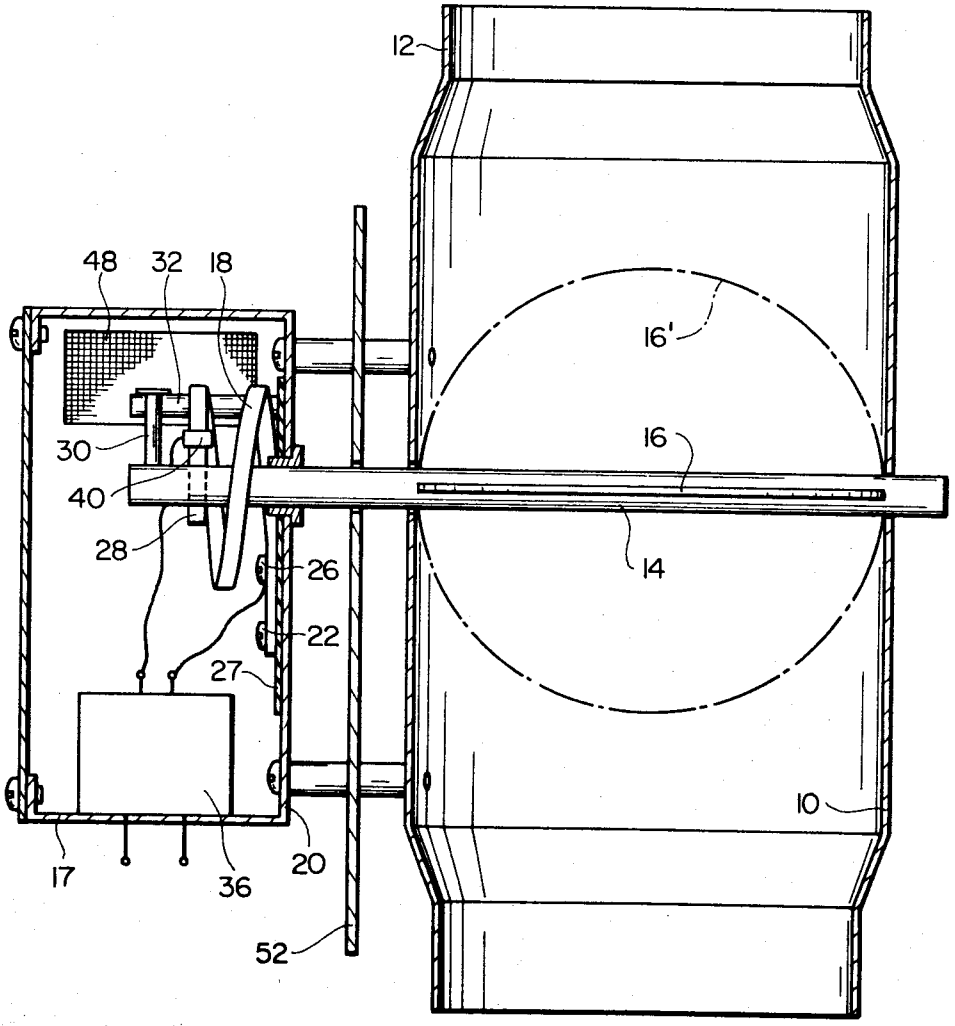
FIG. 2 is a vertical section of the entire vent damper taken along the line 2—2 of FIG. 1.
Figure 1:
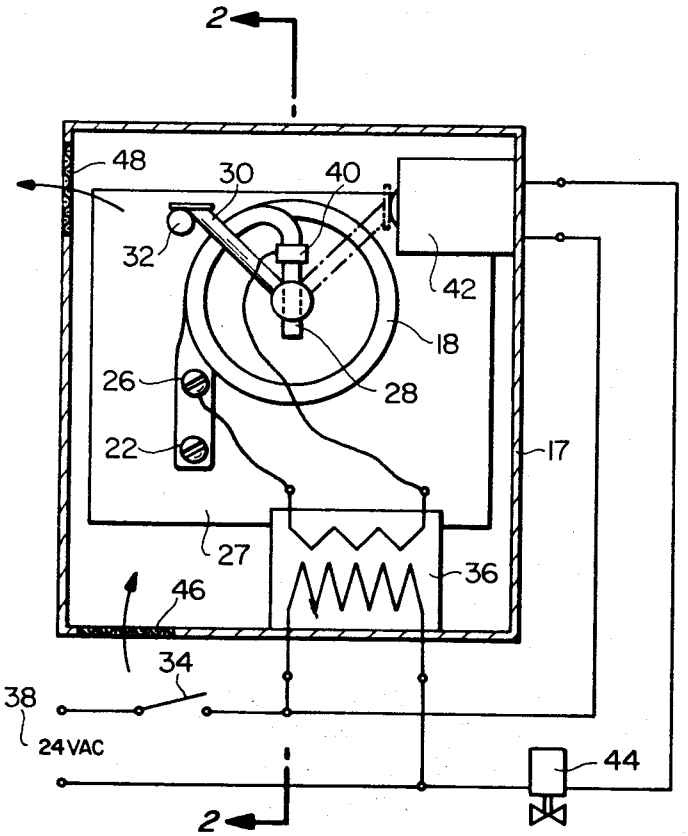
FIG. 1 is a frontal view of the vent damper drive box with the cover removed. The wiring of the damper controls and of pertinent appliance controls is shown schematically.

FIGS. 1 and 2 show an electrically operated vent damper of the invention in which vent damper housing 10 serves as a conduit for the products of combustion rising from the heating appliance or apparatus and flowing into the vent pipe to be attached to collar 12. Rigidly mounted on shaft 14 is a damper plate 16 shown in its closed position. The outline of the damper plate in the open position 16' is indicated by dash-dot lines. The shaft 14 extends through a damper drive box 17. A damper actuating element 18, shown in the form of a helix, is fastened to the damper drive box wall 20 and an intermediate insulating plate 27 by bolts 22 and 26. The free end 28 of helix 18 fits in a close tolerance bore through shaft 14.

The damper actuating helix 18 is comprised of a shape memory material, such as nitinol, that, after heat treatment with concurrent mechanical deformation, is capable of thermoelastic martensitic reversion, also called reversible shape memory. Helix 18 is manufactured and treated so that below the shape change temperature range it maintains the shape shown in FIGS. 1 and 2, whereby damper 16 is closed. At this position lever 30 touches stop 32.

When themostat 34, which may be the room thermostat for a furnace or the aquastat for a water heater, calls for heat it connects transformer 36 to the power supply 38. The secondary winding of transformer 36, designed for low voltage ohmic resistance heating and connected to helix 18 at bolt 26 and connector 40, starts heating helix 18. When the helix is heated to deformation temperature, e.g. 80° C., it deforms so that its free end 28 rotates 90° clockwise until lever 30, which is attached to shaft 14, touches normally open limit switch 42 which also serves as a stop for the movement of lever 30. Damper 16 is now in the open position 16'. The closing of limit switch 42 activates solenoid gas valve 44. The gas valve opens and the appliance main burner, which is not shown, fires.

When heat demand is satisfied thermostat 34 opens and interrupts the circuit to solenoid gas valve 44 and transformer 36. The gas valve closes and main burner operation ceases. The now unheated helix 18 cools down. When the temperature of the helix reaches the reversion temperature, e.g. 70° C., in practice after approximately 10 seconds, it deforms and returns to its initial shape whereby the free end 28 rotates 90° counterclockwise and closes damper 16. The time interval between gas valve closing and damper closing allows for the exit of residual products of combustion. The time interval can be determined by the degree to which helix 18 is heated above the shape change temperature, by the size of ventilation openings 46 and 48, or by the shape of helix 18, or by any combination of the foregoing. Openings 46 and 48 are made with predetermined sizes which establish the air flow through box 17 for cooling the helix at a controlled rate and thereby control the damper operating cycle time.

The wiring which is shown schematically in FIG. 1 provides certain safety features. The appliance main burner, controlled by solenoid gas valve 44, can start only after the damper plate 16 is in the open position 16' and stop 32 activates limit switch 42. If, for any reason, shaft 16 rotates away from the fully open position, current to solenoid gas valve 44 is interrupted and gas supply to the main burner stops.

A heat shield 52 is mounted between housing 10 and 17. The shield reduces heat transfer to damper drive box 17 from the vent gases flowing through damper housing 10. Most two-way shape memory materials usually develop more force when deforming from cold to hot than when reverting from hot to cold. Helix 18 is designed to exert sufficient torque for all operational requirements in both the opening and the closing direction. However, if an unusual resistance to the turning of shaft 14 should develop, the damper will fail in the open position since the force to open the damper is the stronger of the two forces. This provides an additional fail-safe feature.

The above described embodiment eliminates the requirement for a drive motor, gears, closing delay mechanism and return spring.

Figure 4:
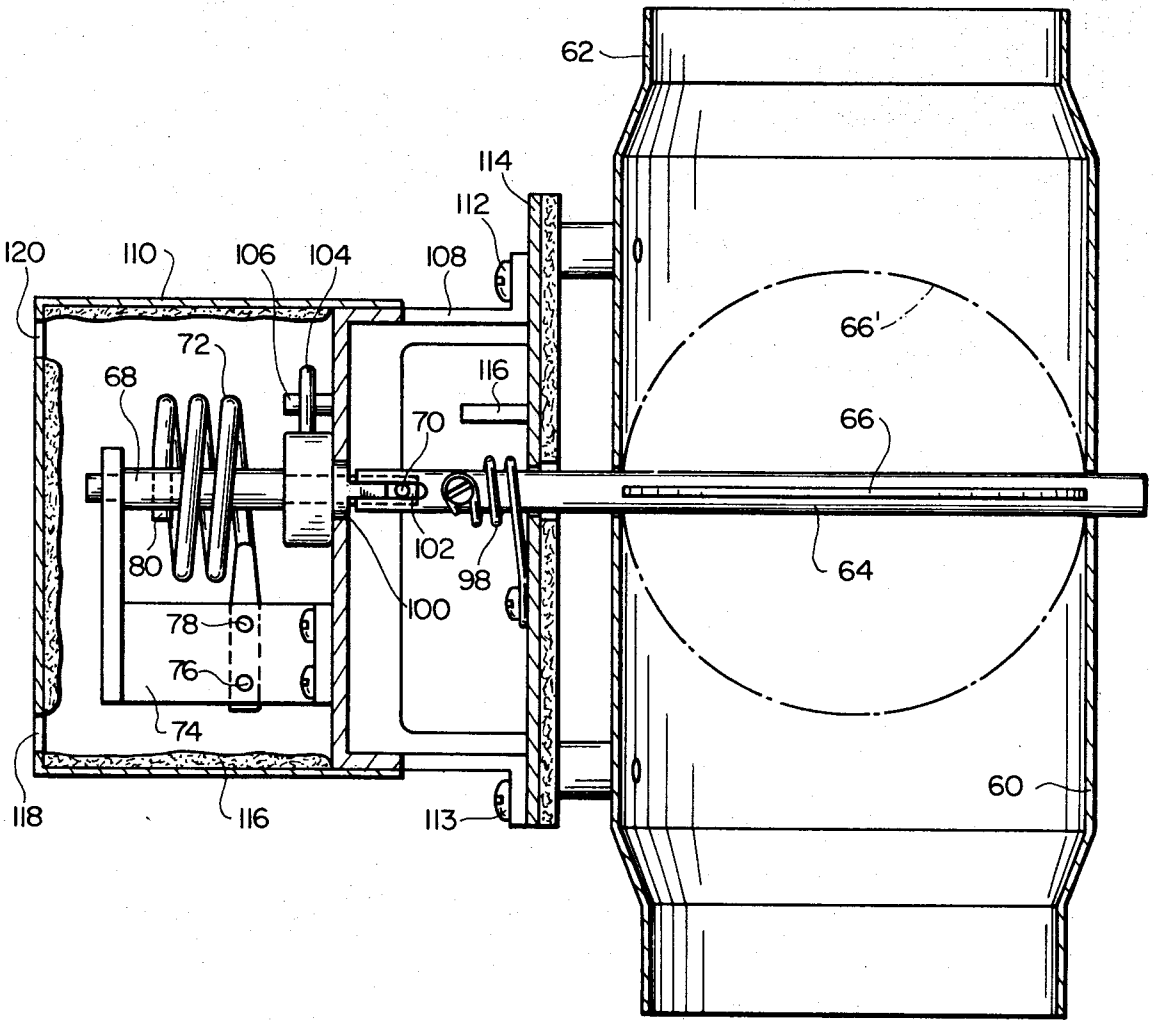
FIG. 4 is a vertical section of the second embodiment showing the entire vent damper taken along the line 4—4 of FIG. 3.
Figure 3:
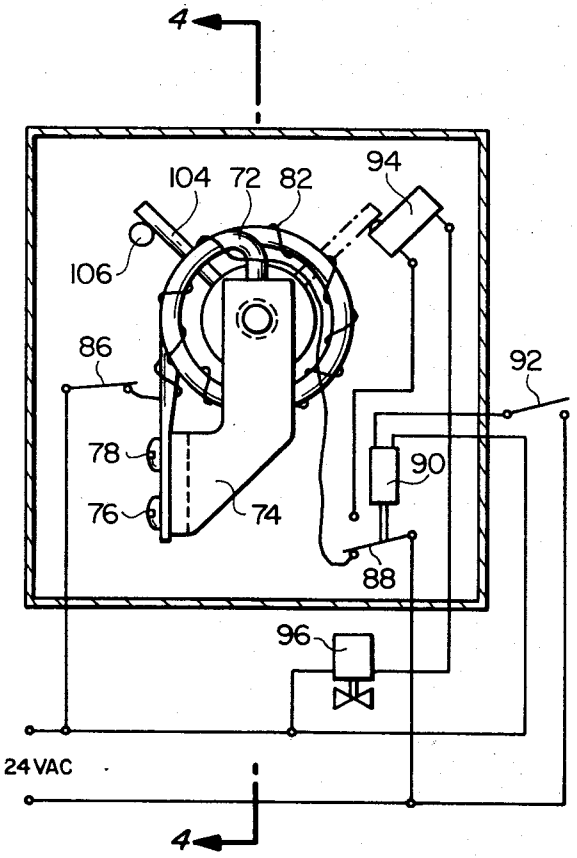
FIG. 3 is a frontal view of a second embodiment showing the vent damper drive box with the cover removed. The wiring of the damper controls and of pertinent appliance controls is shown schematically.

If the vent damper is intended for an installation that requires the damper to open on power failure the embodiment shown in FIGS. 3 and 4 can be used.

Damper housing 60 serves as a conduit for the products of combustion rising from the appliance and flowing into the vent pipe to be attached to collar 62. Rigidly mounted on shaft 64 is damper plate 66 shown in its closed position. The outline of the damper plate in its open position is indicated by dash-dot line 66'. The end of shaft 64 pointing toward the drive box is hollow and is provided with a slot 102 which detachably couples with drive shaft 68 which is fitted with pin 70. Helix 72 is fastened to support arm 74 by bolts 76 and 78. Its free end 80 fits in a close tolerance bore through drive shaft 68. Helix 72 is made of a shape memory material and is wrapped with heating cable 82 shown in FIG. 3. It has been omitted from FIG. 4 for clarity.

In the damper-closed position shown in FIGS. 3 and 4 current from power supply 84, in this case the 24 VAC supply, flows through a branch circuit which includes thermostat 86, heating cable 82 and closed contact 88 of relay 90. Helix 72 is heated above deformation temperature and maintains its high-temperature shape.

When thermostat 92, which may be the room thermostat for a furnace or the aquastat for a water heater, calls for heat the relay 90 is energized through an appliance operating circuit which is operable between different modes for interrupting the heating cable circuit at 88 and connecting the circuit to limit switch 94 and solenoid gas valve 96. Since limit switch 94 is normally open current does not yet flow in this circuit. The now unheated helix 72 cools down and deforms to change shape whereby free end 80 rotates 90° clockwise, turning drive shaft 68 and through pin 70 also turning shaft 64 and opening damper 66.

It is assumed that in this embodiment, for economic or other reasons, a shape memory material has been selected for helix 72 which during its shape change from warm to cold exerts only a small fraction of the torque that it develops from cold to warm. For the purpose of balancing the forces in both directions a spring 98 assists in the opening movement of the damper.

Freely rotating on drive shaft 68 is hub 100 whose extension engages in the slot 102 of shaft 64 and thereby rotates exactly as shaft 64. The hub 100 is freely mounted about the reduced diameter end of drive shaft 68.

The rotary motion of helix 72, drive shaft 68 and shaft 64 to the open position as described above is transmitted as a feedback to hub 100. A lever 104 is fastened to hub 100 and is moved by the hub to touch and close normally open limit switch 94 which also serves as a stop for the opening movement. The circuit through limit switch 94 and solenoid gas valve 96 is now under current. The gas valve opens and burner operation starts. The circuit through switch 94 is interlocked with the branch circuit through heating cable 82 in that current can be directed to valve 96 only when relay 90 is operated to open contact 88 and switch off current to cable 82.

When the demand for heat is satisfied thermostat 92 opens, relay 90 disconnects power to the solenoid valve 96 which closes and thereby stops main burner operation. At the same time relay 90 connects heating cable 82 to the power supply, thereby starting to heat helix 72. When the helix reaches deformation temperature its free end 80 turns the coupled shafts 68 and 64 90° counterclockwise until lever 104 touches stop 106. The time interval between the closing of the solenoid gas valve 96 and the heating of helix 72 to deformation temperature, in practice approximately 10 seconds, allows for the escaping of residual products of combustion. While helix 72 turns the coupled shafts counterclockwise it also winds spring 98.

The above-described embodiment has a number of safety features and practical advantages for its operation and maintenance. The drive box consisting of frame 108, the drive mechanism and cover 110 may be removed as a unit for testing, repair or replacement. As soon as bolts 112 and 113 are removed and the drive box is lifted from base plate 114 shafts 68 and 64 disengage and spring 98 rotates shaft 64 with damper 66 to the open position whereby a lever (not shown) attached to the back side of shaft 64 touches stop 1116. The spring pressure against stop 116 holds the damper in the open position until the drive unit is reinstalled.

The person removing the drive unit has the choice of keeping the appliance working normally by connecting thermostat 92 and solenoid gas valve 96, or to keep the appliance from operating. In the latter case, even if all wiring to the drive unit is still in place the appliance will not operate since freely rotating hub 100 does not press against and activate limit switch 94, regardless of the position of helix 72 and drive shaft 68.

Spring 98 therefore serves the double purpose of assisting the shape memory alloy helix 72 to actuate the damper, and to open the damper and retain it in open position when the drive unit is removed.

Also in the case of power failure the damper assumes the open position. Without power for heating helix 72 the helix cools down and, assisted by spring 98, rotates the coupled shafts 68 and 64 with damper 66 to the open position 66'.

The previously described feedback of the rotary movement of shaft 64 through hub 100 and lever 104 to limit switch 94 assures that the solenoid gas valve 96 can only open when damper 66 is in its open position 66' and products of combustion can flow freely through the vent.

Limit switch 94 could of course also be installed outside the drive box, near base plate 114 and could be activated by a lever fastened directly to shaft 64, however it is preferable to keep the control elements and wiring together in the protective, removable enclosure.

Heating cable 82 causes a certain temperature rise in helix 72 above ambient temperature. This temperature rise must be designed to be safely above the range of shape change, e.g. 70° to 80° C., of the shape memory alloy, even when the ambient temperature at the appliance is low, e.g. 10° C. On the other hand there is no need to heat helix 72 to a temperature much higher than the shape change temperature range which would occur if ambient temperature at the appliance is high, e.g. 45° C. To prevent unnecessary heating of helix 72 thermostat 86 installed near helix 72 is designed to disconnect the heating cable at a preset temperature, e.g. 130° C.

The energy required for heating helix 72 can be reduced by insulating material 116 installed at the inside walls of cover 110 and by keeping ventilation openings 118 and 120 small.

The helices shown in the two embodiments may be made of differently shaped alloys such as solid round, tubular, square or flat stock.

Instead of a helix the shape memory alloy may also be shaped as a flat coil spring, a torsion bar or a torsion tube.

Heating of the shape memory alloy may be by ohmic resistance heating or heating cable, as shown in the two embodiments, or by radiation from a heating element in close proximity to the alloy.

Certain features shown in one embodiment may be used in the other. High temperature limiting thermostat 86, for instance, shown in FIG. 3 may be added to FIG. 1.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. In a heating appliance having a damper for controlling the flow of exhaust gases through a vent, the combination of a damper actuating element comprised of a material having a shape memory effect and coupled to apply an actuating force to move the damper between closed and open positions within the vent when the element deforms between first and second shapes, respectively, said element assuming its first shape when at a temperature above its deformation temperature and assuming its second shape when at a temperature below the deformation temperature, and means for heating the element above the deformation temperature for causing deformation of the element toward the first shape and thereby movement of the damper toward its closed position.

2. The invention of claim 1 in which the element when deforming toward its first shape applies the actuating force for moving the damper toward its closed position, together with means for applying a restoring force for returning the damper toward its open position when the element is deforming toward its second shape.

3. The invention of claim 2 in which the means for applyng the restoring force to the damper comprises a spring.

4. The invention of claim 1 including control means for energizing the heating means responsive to a shut-down mode of the heating appliance whereby the actuating element assumes its first shape with the damper in its closed position, said control means de-energizing the heating means responsive to a heating mode of the appliance whereby the actuating element assumes its second shape and moves the damper to its second position for opening the vent.

5. The invention of claim 4 in which the control means includes electrical circuit means for heating the actuating element by ohmic resistance.

6. The invention of claim 1 in which the damper comprises a rigid plate.

7. The invention of claim 1 further comprising control means including electrical circuit means for energizing the heating means responsive to a shut-down mode of the heating appliance, said circuit means including an appliance operating circuit operable between first and second modes for respectively turning on and off said heating appliance, together with feedback means coupled with the damper for actuating the appliance operating circuit to turn the heating appliance on responsive to the damper being in its open position.

8. The invention of claim 1 which includes a box-shaped enclosure forming a chamber in which the heating means is positioned, together with vent means formed in the enclosure for controlling a flow of ambient air through the chamber in heat exchange relationship with the heating means for cooling the heating means at a controlled rate for controlling the damper operating cycle time.

9. The invention of claim 1 which includes a box-shaped enclosure forming a chamber in which the heating means is positioned, together with control means including branch circuit means for heating the actuating element, said branch circuit means including high temperature limit switch means for opening the circuit responsive to temperature within the chamber above a predetermined level.

10. The invention of claim 1 which includes means for directly coupling the damper actuating element with the damper for achieving damper opening, damper closing, closing delay and safety functions through a minimum number of components and moving parts and with said actuating element being coupled with the damper for moving the same to its open position for opening the vent when the actuating element assumes its second shape when below the deformation temperature so that the damper is maintained in its opened position upon power failure or upon any detachment of the actuating element from the damper.

* * * * *